US011782363B2

(12) United States Patent
Matsuura

(10) Patent No.: US 11,782,363 B2
(45) Date of Patent: Oct. 10, 2023

(54) IMAGE FORMING APPARATUS

(71) Applicant: CANON KABUSHIKI KAISHA, Tokyo (JP)

(72) Inventor: Taisuke Matsuura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/549,487

(22) Filed: Dec. 13, 2021

(65) Prior Publication Data

US 2022/0187740 A1 Jun. 16, 2022

(30) Foreign Application Priority Data

Dec. 15, 2020 (JP) ..... 2020-207367

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 6,125,244 A * 9/2000 Kamiya ..... G03G 15/6558 399/388
10,551,762 B2 2/2020 Kohno
2007/0217832 A1* 9/2007 Oyama ..... G03G 15/1605 399/302

FOREIGN PATENT DOCUMENTS

JP 2001-139185 A 5/2001
JP 2004-061908 A 2/2004
JP 2015-014622 A 1/2015
JP 2019-086552 A 6/2019

* cited by examiner

*Primary Examiner* — Stephanie E Bloss
*Assistant Examiner* — Michael A Harrison
(74) *Attorney, Agent, or Firm* — Venable LLP

(57) ABSTRACT

An image forming apparatus includes a belt, an image forming unit, a first roller configured to form a transfer portion where the toner image is transferred from the belt to a recording material, a second roller disposed upstream of the first roller, a pressing member disposed upstream of the first roller and downstream of the second roller, a guide member disposed upstream of the transfer portion, and a connecting member configured to electrically connect the guide member and the pressing member to each other.

22 Claims, 5 Drawing Sheets

IMAGE FORMING APPARATUS

BACKGROUND OF THE INVENTION

Field of the Invention

This disclosure relates to an image forming apparatus, such as a printer, a copier, a facsimile machine, and a compound machine, that uses an electrophotographic technique.

Description of the Related Art

Hitherto, an image forming apparatus of an intermediate transfer system is, for example, used as an image forming apparatus to form an image on a recording material. In the image forming apparatus of the intermediate transfer system, a toner image formed on a photosensitive drum is transferred to an intermediate transfer belt upon the application of a primary transfer voltage. Thereafter, when a strong electric field is generated upon the application of a secondary transfer voltage to a secondary transfer nip portion formed between a secondary transfer inner roller and secondary transfer outer roller disposed across the intermediate transfer belt, the toner image on the intermediate transfer belt is transferred to the recording material which passes through the secondary transfer nip portion. Hitherto, so as to prevent faulty transfer (for example, transfer omission, transfer dust, and the like) from the intermediate transfer belt to the recording material, an apparatus disposed with a pressing member upstream of the secondary transfer nip portion in a rotational direction of the intermediate transfer belt is suggested (Japanese Patent Laid-Open No. 2004-061908). Similar to the secondary transfer inner roller, the pressing member is disposed inside the intermediate transfer belt, and presses the intermediate transfer belt from the inside so that the intermediate transfer belt protrudes to the outside (side of the secondary transfer outer roller). Herewith, the pressing member brings the intermediate transfer belt and the recording material coming into close contact with each other more easily.

Incidentally, the recording material is guided to the secondary transfer nip portion while a posture is being controlled by a conveyance guide including upper and lower guide plates. So as to bring the intermediate transfer belt and the recording material into close contact with each other and to prevent a trailing edge of the recording material from strongly contacting with the intermediate transfer belt when the trailing edge has passed through the conveyance guide, it is desirable to dispose an end of the upper guide plate on a side of the secondary transfer nip portion adjacently to a side of the intermediate transfer belt. However, since the conveyance guide is charged by slide contact with the recording material, especially, in a configuration in which the conveyance guide is put aside to the side of the intermediate transfer belt, part of a toner on the intermediate transfer belt scatters and adheres to the conveyance guide easily, and, as a result, the recording material is possibly soiled. Therefore, hitherto, similar to the apparatus described in Japanese Patent Laid-Open No. 2004-061908, the adhesion of the toner from the intermediate transfer belt to the conveyance guide is suppressed by applying a voltage with the polarity opposite the charge polarity of the toner to the pressing member having electrical conductivity.

However, in the case where the voltage with the polarity opposite the charge polarity of the toner is applied to the pressing member as described above, since it becomes necessary to dispose a voltage applying unit to apply the voltage, in addition to applying the primary and secondary transfer voltages, to the pressing member, the apparatus becomes complicated so that a size and also cost are increased. Therefore, hitherto, an apparatus which is capable of achieving both of the suppression of the faulty transfer from the intermediate transfer belt to the recording material and the suppression of the adhesion of the toner from the intermediate transfer belt to the conveyance guide with a simple configuration has been awaited, but such an apparatus has not yet been suggested.

SUMMARY OF THE INVENTION

According to one aspect of the present invention, an image forming apparatus includes a belt in an endless shape, an image forming unit configured to form a toner image on the belt, and a plurality of stretching rollers configured to stretch the belt on a side of an inner surface of the belt, the plurality of stretching rollers including a first roller configured to form a transfer portion where the toner image is transferred from the belt to a recording material with a transfer member coming into contact with an outer circumferential surface of the belt, and a second roller being adjacent to the first roller and disposed upstream of the first roller in a rotational direction of the belt, a second roller being adjacent to the first roller and disposed upstream of the first roller in a rotational direction of the belt, a pressing member disposed upstream of the first roller and downstream of the second roller in the rotational direction of the belt, and configured to press the belt from an inside, a guide member disposed upstream of the transfer portion in a conveyance direction of the recording material, and configured to guide the recording material toward the transfer portion, and a connecting member configured to electrically connect the guide member and the pressing member to each other.

Further features of the present invention will become apparent from the following description of exemplary embodiments with reference to the attached drawings.

DESCRIPTION OF THE EMBODIMENTS

First Embodiment

Figure 1:
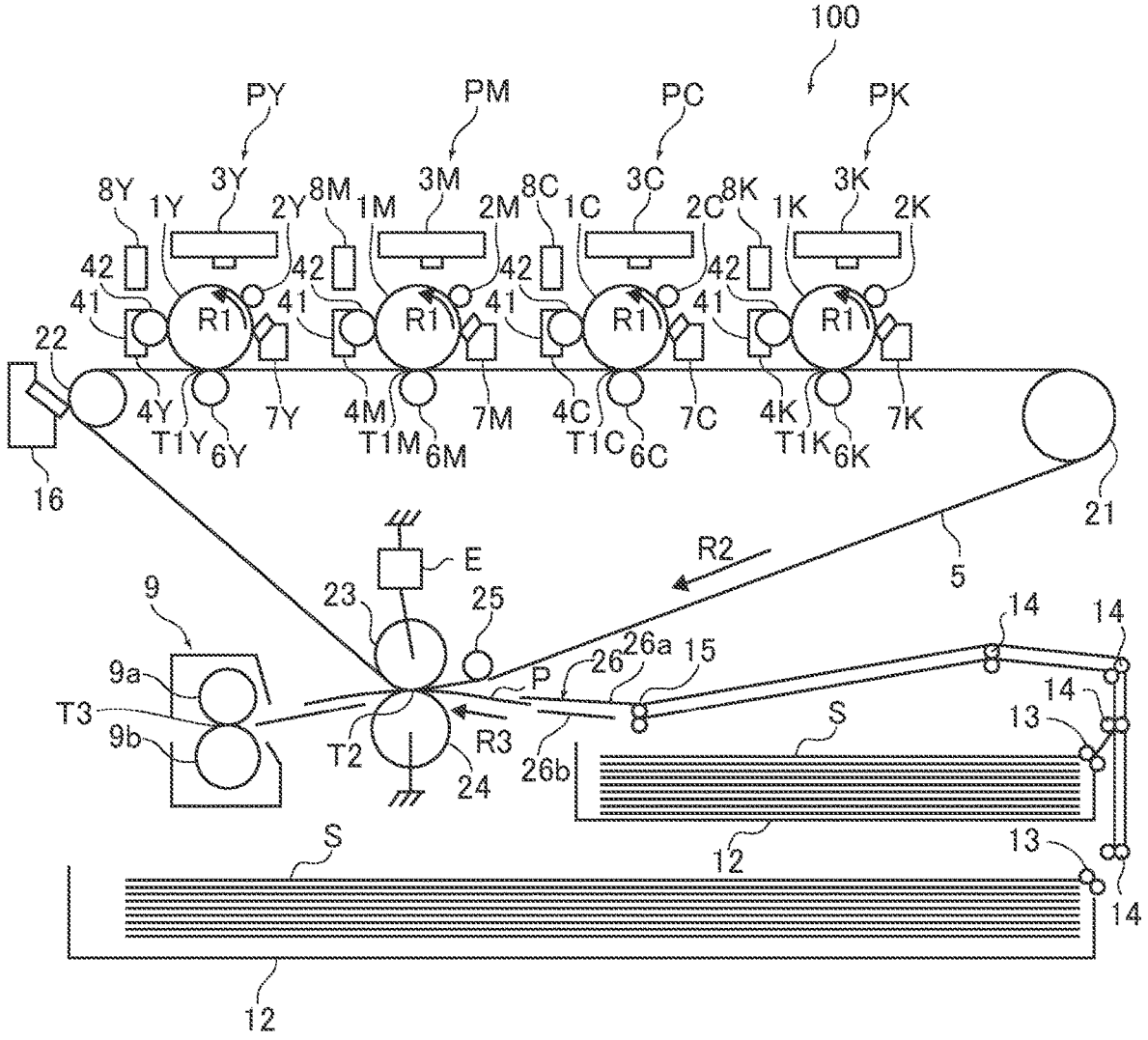
FIG. 1 is a schematic diagram showing an image forming apparatus pertinent to this embodiment.

At first, using FIG. 1, a configuration of an image forming apparatus of this embodiment will be described. The image forming apparatus 100 shown in FIG. 1 is a full color printer of an intermediate transfer system including image forming units PY, PM, PC, and PK of yellow, magenta, cyan, and black along an intermediate transfer belt 5 that is an endless belt. To be noted, in the following descriptions, unless otherwise specifically stated, "upstream" (upstream side) and "downstream" (downstream side) indicate "upstream" (upstream side) and "downstream" (downstream side) with respect to a rotational direction (arrow R2 direction) of the intermediate transfer belt 5.

The image forming apparatus 100 forms a toner image on a recording material S in accordance with an image signal transmitted from a document reading apparatus (not shown) or an external apparatus such as a personal computer (not shown). The recording material S includes various kinds of sheet materials such as paper including standard paper, cardboard, rough paper, uneven paper, coated paper, and the like, plastic film, and cloth. The recording material S is stored inside one or a plurality of cassettes 12.

The image forming apparatus 100 includes the image forming units PY, PM, PC, and PK respectively forming images of yellow, magenta, cyan, and black on the intermediate transfer belt 5. In the image forming unit PY, the toner image of yellow is formed on a photosensitive drum 1Y, and transferred (primarily transferred) to the intermediate transfer belt 5. In the image forming unit PM, the toner image of magenta is formed on a photosensitive drum 1M, and transferred in piles or layers to the intermediate transfer belt 5. In the image forming units PC and PK, the toner images of cyan and black are respectively formed on photosensitive drums 1C and 1K, and transferred in piles to the intermediate transfer belt 5. These image forming units PY, PM, PC, and PK are substantially the same in configuration except for colors of the toners contained in two-component developers used in developing units 4Y, 4M, 4C, and 4K. Therefore, in the following, the image forming unit PY of yellow will be described as representative, and descriptions of the other image forming units PM, PC, and PK will be omitted herein.

The image forming unit PY is mainly constituted by the photosensitive drum 1Y, a charge unit 2Y, an exposing unit 3Y, the developing unit 4Y, a photosensitive drum cleaner 7Y, and the like. The photosensitive drum 1Y is formed by coating a photosensitive layer of an OPC (organic photo conductor) on a circumferential surface of an aluminum cylinder having an outer diameter of, for example, 30 mm (millimeters). The photosensitive drum 1Y is rotatably driven in an arrow R1 direction. A surface of the photosensitive drum 1Y has been uniformly charged by the charge unit 2Y beforehand, and, thereafter, an electrostatic latent image is formed on the surface of the photosensitive drum 1Y by the exposing unit 3Y driven based on the image signal.

The electrostatic latent image formed on the photosensitive drum 1Y is developed to the toner image by the developing unit 4Y by using the two-component developer containing a non-magnetic toner and magnetic carrier. The developing unit 4Y develops the electrostatic latent image to the toner image by supplying the toner to the photosensitive drum 1Y. That is, in the developing unit 4Y, a developing sleeve 42 disposed across a little gap from a surface of the photosensitive drum 1Y is rotated in a counter direction of the photosensitive drum 1Y. Herewith, the toner in the two-component developer stored in a storing container 41 is charged, and conveyed to an opposite portion opposite the photosensitive drum 1Y by the developing sleeve 42. In a case of this embodiment, the toner is charged in a negative polarity (regularly charged). Then, the electrostatic latent image is developed in a manner of reversal development by moving the toner charged in the negative polarity to an exposure part on the photosensitive drum 1Y upon the application of an oscillation voltage, which superposes an alternate-current voltage upon a direct-current voltage, to the developing sleeve 42, so that the toner image is formed on the photosensitive drum 1Y. To be noted, the toner for replenishment to the developing unit 4Y is stored in a toner replenishment container 8Y, and the toner is replenished from the toner replenishment container 8Y to the developing unit 4Y.

Then, upon the application of a primary transfer voltage to a primary transfer roller 6Y disposed opposite the image forming unit PY across the intermediate transfer belt 5, the toner image formed on the photosensitive drum 1Y is transferred (primarily transferred) to the intermediate transfer belt 5 at a primary transfer nip portion T1Y. The primary transfer roller 6Y comes into pressure contact with the intermediate transfer belt 5, so that primary transfer nip portion T1Y is formed between the photosensitive drum 1Y and the intermediate transfer belt 5. The toner image (negative polarity) on the photosensitive drum 1Y is transferred to the intermediate transfer belt 5 by applying the direct-current voltage with the polarity (in this embodiment, positive polarity) opposite the charge polarity of the toner. The primary transfer roller 6Y comes into contact with the intermediate transfer belt 5 at, for example, a total pressure of 1.5 kgf (kilograms force), and is rotatably driven by the intermediate transfer belt 5. In this embodiment, a cylindrically shaped metallic member coated with an electrically conductive elastic member having an electric resistance of $5.0\times10^6$ Ω/cm (ohms per centimeter) and a thickness of 1.0 mm is used for the primary transfer roller 6Y.

A primary transfer residual toner remains on the photosensitive drum 1Y after the transfer is collected by the photosensitive drum cleaner 7Y. In the photosensitive drum cleaner 7Y, for example, a cleaning blade (not shown) made from polyurethane comes into slide contact with the photosensitive drum cleaner 7Y.

The intermediate transfer belt 5, serving as an image bearing belt, is an endlessly shaped belt member rotating by coming into contact with the photosensitive drums 1Y to 1K. The intermediate transfer belt 5 is stretched by a plurality of stretching rollers (in this embodiment, a tension roller 21, drive roller 22, and secondary transfer inner roller 23), and driven in the arrow R2 direction by the drive roller 22. The tension roller 21, drive roller 22, and secondary transfer inner roller 23 come into contact with an inner circumferential surface of the intermediate transfer belt 5, and stretch the intermediate transfer belt 5 from a side of the inner circumferential surface. The tension roller 21, serving as the stretching roller, is a metallic roller, and is disposed upstream of the secondary transfer inner roller 23, serving as an inner roller, in the rotational direction of the intermediate transfer belt 5, and urges the intermediate transfer belt 5 from the inside toward the outside by a tension spring (not shown). The drive roller 22 is a rubber roller including an electrically conductive rubber layer as a surface layer on a metallic core. In this embodiment, the drive roller 22 having the electrical resistance of $1.0\times10^3$ to $1.0\times10^5$Ω (upon application of 100 V (volts)) is used, and the metallic core of this drive roller 22 is electrically grounded.

Image forming processes carried out in parallel by the image forming units PY to PK are performed in a timing superimposing the toner image on an upstream toner image primarily transferred onto the intermediate transfer belt 5. Consequently, a full color toner image is eventually formed on the intermediate transfer belt 5, and conveyed to a secondary transfer nip portion T2. To be noted, a secondary transfer residual toner remaining on the intermediate transfer belt 5 after passing through the secondary transfer nip portion T2 is collected by a belt cleaner 16.

The recording material S is pulled out one sheet at a time from the cassette 12 by a feed roller 13, and conveyed to a registration roller 15 by a plurality of conveyance rollers 14. The toner image formed on the intermediate transfer belt 5 is conveyed to the secondary transfer nip portion T2, and secondarily transferred to the recording material S. The secondary transfer nip portion T2 is a transfer nip portion formed by the secondary transfer inner roller 23 and a secondary transfer outer roller 24. That is, in this embodiment, the secondary transfer outer roller 24 serves as a transfer member coming into contact with the outer circumferential surface of the intermediate transfer belt 5, and the secondary transfer inner roller 23 serves as a first roller configured to form the transfer portion T2 transferring the toner image from the intermediate transfer belt 5 to the recording material S in cooperation with the transfer member 24. Further, the tension roller 21 also serves as a second roller being adjacent to the secondary transfer inner roller and disposed upstream of the secondary transfer inner roller 23, serving as the first roller, in the rotational direction of the intermediate transfer belt 5. The registration roller 15 sends the recording material S toward the secondary transfer nip portion T2 in a timing synchronizing with the toner image formed on the intermediate transfer belt 5.

Conveyance Guide

A conveyance guide 26 disposing an upper guide 26*a* and a lower guide 26*b* opposite each other is disposed in a forward direction of the registration roller 15, in which the registration roller 15 sends the recording material S, and the recording material S is sent between the upper and lower guides 26*a* and 26*b* of this conveyance guide 26. The conveyance guide 26 guides the recording material S to the secondary nip portion T2 while regulating a moving direction of the recording material S sent from the feed roller 13 by the upper guide 26*a*, serving as a second guide member (second guide), and the lower guide 26*b*, serving as a first guide member (first guide). That is, the conveyance guide 26 serves as a guide member disposed upstream of the secondary transfer nip portion T2 (transfer portion) in a conveyance direction of the recording material S and guiding the recording material S to the secondary transfer nip portion T2. The upper and lower guides 26*a* and 26*b* are disposed, outside the intermediate transfer belt 5 (on a side of a surface on which the intermediate transfer belt 5 bears the toner image (toner image bearing surface)), across a gap from the intermediate transfer belt 5, in two vertical tiers along the conveyance direction (arrow R3 direction) of the recording material S. The upper guide 26*a* is disposed between the lower guide 26*b* and the intermediate transfer belt 5.

The upper guide 26*a* disposed on a side nearer to the intermediate transfer belt 5 guides a second surface (surface to which the toner image is transferred) of the recording material S while regulating an approaching movement of the recording material S toward the intermediate transfer belt 5. On the other hand, the lower guide 26*b* disposed on a side farther from the intermediate transfer belt 5 guides a first surface (opposite to a surface to which the toner image is transferred) of the recording material S while regulating a departing movement of the recording material S from the intermediate transfer belt 5. In this embodiment, the upper and lower guides 26*a* and 26*b* are formed in a tabular form by metal such as SUS (stainless steel) having the electrical conductivity, and, as described later, the upper and lower guides 26*a* and 26*b* are electrically connected to each other (refer to FIG. 2 described later).

The secondary transfer outer roller 24, serving as a nip forming member, is disposed opposite the secondary transfer inner roller 23 across the intermediate transfer belt 5, and forms the secondary transfer nip portion T2 transferring the toner image from the intermediate transfer belt 5 to the recording material S. Then, in a case of this embodiment, upon the application of the secondary transfer voltage to the secondary transfer inner roller 23 by a secondary transfer high voltage power source E, serving as a voltage applying unit, the toner image on the intermediate transfer belt 5 is transferred to the recording material S nipped and conveyed by the secondary transfer nip portion T2. That is, while the secondary transfer outer roller 24 is grounded (electric potential is 0 V), a voltage (secondary transfer voltage of, for example, −4000 V) with the negative polarity, which is the same polarity as the charge polarity of the toner, is applied to the secondary transfer inner roller 23 by the secondary transfer high voltage power source E. Therefore, a transfer electric field is generated in the secondary transfer nip portion T2. In response to this transfer electric field, the toner images, which are borne on the intermediate transfer belt 5, of yellow, magenta, cyan, and black having the negative polarity are transferred to the recording material S.

The recording material S to which the toner image has been transferred at the secondary transfer nip portion T2 is conveyed toward a fixing unit 9. The fixing unit 9 includes a fixing roller 9*a* and pressing roller 9*b* forming a fixing nip portion T3 by coming into contact with each other, and fixes the toner image on the recording material S at the fixing nip portion T3. In the fixing unit 9, the fixing roller 9*a* is heated by, for example, a lamp, heater, and the like, and the pressing roller 9*b* is brought into pressure contact with the fixing roller 9*a* by an urging member (not shown) so as to form the fixing nip portion T3. The recording material S is provided with heat and pressure during a passage through the fixing nip portion T3, and the toner image is fixed on the recording material S. Thereafter, the recording material S is discharged outside an apparatus body of the image forming apparatus 100.

Next, the intermediate transfer belt 5, secondary transfer inner roller 23, secondary transfer outer roller 24, and a pressing roller 25 will be described. The intermediate transfer belt 5 is formed by resin or the like having a monolayer or multilayer structure with, for example, a thickness of 45 to 100 μm (micrometers), a Young's modulus of equal to or larger than 1.0 GPa (gigapascals), a surface resistivity of $1.0\times10^{9}$ to $1.0\times10^{13}$ Ω/sq (ohms per square), and a volume resistivity of $1.0\times10^{7}$ to $1.0\times10^{12}$ Ω·cm (ohms centimeter). In this embodiment, the intermediate transfer belt 5 is formed by using a polyimide resin film with the thickness of 85 μm as a substrate, and the electric resistance of intermediate transfer belt 5 is adjusted by dispersing carbon black so as to attain the surface resistivity of $1.0\times10^{11}$ Ω/sq and the volume resistivity of $1.0\times10^{9}$ Ω·cm.

The secondary transfer inner roller 23 is a solid roller in which an electrically conductive rubber layer is formed on a surface layer. An outer diameter φ of the secondary transfer inner roller 23 is, for example, 20 mm. On the other hand, the secondary transfer outer roller 24 is a sponge roller, and a surface layer of a sponge rubber (sponge layer) having the electrical conductivity is formed on a metallic core made of, for example, SUS and the like. An outer diameter φ of the secondary transfer outer roller 24 is, for example, 24 mm, and, in such a case, a diameter φ of the metallic core and a thickness of the sponge layer are respectively 12 mm and 6 mm. An electric resistance of the secondary transfer outer roller 24 and the hardness of the sponge layer are respectively adjusted to, for example, $5.0\times10^7\Omega$ and Asker C hardness of 30 degrees. The secondary transfer outer roller 24 as described above is urged toward the secondary transfer inner roller 23 by a spring (not shown) at both ends in a rotational axis direction of the secondary transfer outer roller 24, and presses the secondary transfer inner roller 23 at, for example, a total pressure of 6.5 kgf.

Pressing Roller

Further, inside the intermediate transfer belt 5, the pressing roller 25, serving as a pressing member pressing the intermediate transfer belt 5 from the inside, is disposed upstream of the secondary transfer inner roller 23 (the first roller) and downstream of the tension roller 21 (the second roller). The pressing roller 25 is a metallic roller having the electrical conductivity, and a length of the pressing roller 25 in a width direction intersecting with the rotational direction of the intermediate transfer belt 5 is formed so as to enable the pressing roller 25 to come into contact with the intermediate transfer belt 5 over a whole length of the intermediate transfer belt 5 in the width direction. This pressing roller 25 is disposed so that a length of the close contact of the recording material S with the intermediate transfer belt 5 is secured as long as possible on the upstream side of the secondary transfer nip portion T2. This is because, if the recording material S does not come into close contact with the intermediate transfer belt 5 with a certain length on the upstream side of the secondary transfer nip portion T2, a gap is formed between the recording material S and intermediate transfer belt 5, and faulty transfer such as transfer omission caused by abnormal discharge and the like becomes easy to occur at the relevant part.

Next, using FIG. 2, arrangements of the pressing roller 25 and conveyance guide 26 will be described. The pressing roller 25 is disposed at a vertical position (position in a vertical direction in FIG. 2) where the gap between the recording material S entering the secondary transfer nip portion T2 and the intermediate transfer belt 5 is hardly created. By pressing the intermediate transfer belt 5 by the pressing roller 25, a stretched surface formed between the secondary transfer inner roller 23 and the tension roller 21 protrudes outside an imaginary stretched surface which is formed in a case where the pressing roller 25 is not disposed. In other words, the intermediate transfer belt 5 is brought to protrude, on a side where the secondary transfer inner roller 23 and tension roller 21 each stretch the intermediate transfer belt 5, outside a common tangent F in contact with both the secondary transfer inner roller 23 and tension roller 21. For example, it is preferred to dispose the pressing roller 25 so that the intermediate transfer belt 5 protrudes outside from the common tangent F by 1.0 to 3.0 mm.

Further, the pressing roller 25 is disposed in a predetermined horizontal position (rightward-leftward position in FIG. 2) so as not to obstruct the driving of the secondary transfer inner and outer rollers 23 and 24. For example, it is preferred to dispose the pressing roller 25 so that the pressing roller 25 comes into contact with the intermediate transfer belt 5 at a position separated from an inlet port of the secondary transfer nip portion T2 to the upstream side by 3 to 15 mm.

On the other hand, it is preferred to dispose the conveyance guide 26 so that the conveyance guide 26 is positioned on the upstream side of the intermediate transfer belt 5 as compared with the most downstream position Q where the pressing roller 25 presses the intermediate transfer belt 5. This is because, if the recording material S does not come into close contact with the intermediate transfer belt 5 with a certain length on the upstream side of the secondary transfer nip portion T2, a gap is formed between the recording material S and intermediate transfer belt 5, and the faulty transfer such as the transfer omission caused by the abnormal discharge and the like becomes easy to occur at the relevant part. So as to prevent this faulty transfer, it is preferred to guide the recording material S over a length of, for example, equal to or more than 5 mm to 10 mm along the intermediate transfer belt 5 on the upstream side of the secondary transfer nip portion T2. Therefore, it is preferred to dispose the conveyance guide 26 so that an end of the upper guide 26*a* is positioned on the upstream side of the intermediate transfer belt 5 as compared with the most downstream position Q.

Figure 2:
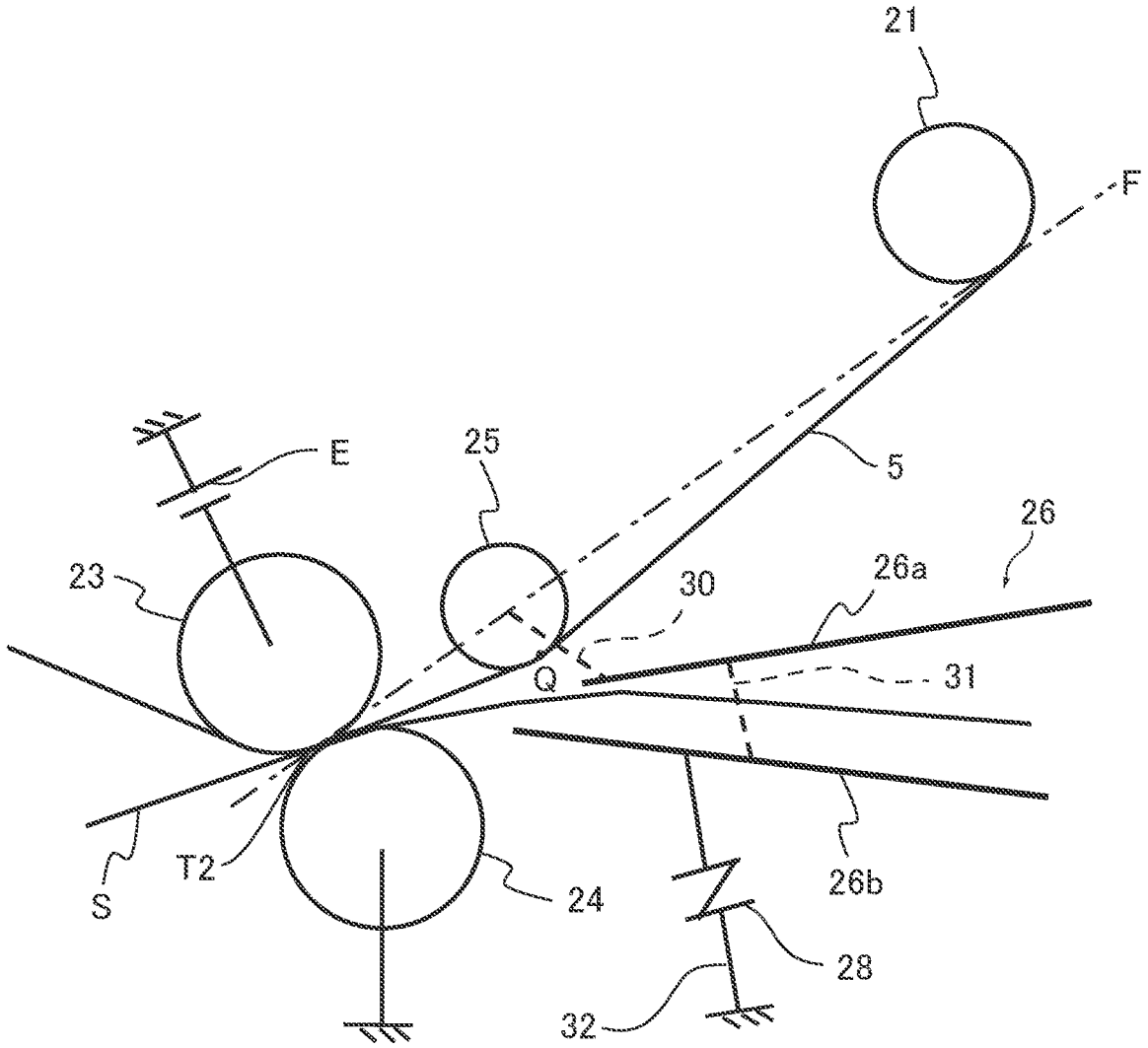
FIG. 2 is a schematic diagram showing arrangements and electrical connecting relations of a pressing roller and conveyance guide.

To be noted, as shown in FIG. 2, it is acceptable to dispose the secondary transfer outer roller 24 by shifting (offsetting) to the upstream side with respect to the secondary transfer inner roller 23. It is preferred since, herewith, the length of the close contact of the recording material S with the intermediate transfer belt 5 on the upstream side of the secondary transfer nip portion T2 is secured longer. A shift amount of the secondary transfer outer roller 24 with respect to the secondary transfer inner roller 23 is, for example, 3 mm.

Next, an electrical connecting between the pressing roller 25 and conveyance guide 26 in this embodiment will be described. In FIG. 2, a dotted line indicates the electrical connecting.

As described above, the pressing roller 25 is the metallic roller member, and the upper and lower guides 26*a* and 26*b* are the metallic tabularly formed members. In this embodiment, these pressing roller 25, upper guide 26*a*, and lower guide 26*b* having the electrical conductivity are electrically connected to each other by electrically conductive members 30 and 31, which are, for example, a metallic conduction member, copper wire, and the like, so that the pressing roller 25, upper guide 26*a*, and lower guide 26*b* are maintained at an equipotential. In an example shown in FIG. 2, in the conveyance guide 26, the upper and lower guides 26*a* and 26*b* are electrically connected to each other via the electrically conductive member 31, serving as a connecting member, and, in addition, the pressing roller 25 is electrically connected to the upper guide 26*a* (conveyance guide 26) via the electrically conductive member 30, serving as the connecting member. Further, the lower guide 26*b* is grounded by an electrically conductive member 32 via a varistor 28 of, for example, 2.4 kV (kilovolts).

To be noted, it is acceptable to electrically connect the pressing roller 25 not to the upper guide 26*a* but to the lower guide 26*b*, or acceptable to electrically connect the pressing roller 25 to both of the upper and lower guides 26*a* and 26*b*. Further, it is acceptable that not the lower guide 26*b* but the upper guide 26*a* is grounded via the varistor 28.

As described above, in this embodiment shown in FIG. 2, the lower guide 26*b* is grounded via the varistor 28 of, for example, 2.4 kV. If the varistor 28 is not disposed, when the recording material S has passed through the secondary transfer nip portion T2 with the secondary transfer voltage applied to the secondary transfer inner roller 23, part of a transfer current becomes easy to flow to the conveyance guide 26, which comes into contact with the recording material S, via the recording material S. If the transfer current flows to a side of the conveyance guide 26, the transfer current does not adequately flow to the secondary transfer nip portion T2 for transferring the toner. The varistor 28 is disposed so as to prevent this. That is, the varistor 28 has a characteristic of not flowing an electrical current until a voltage reaches a predetermined voltage. Therefore, in a case where the varistor 28 is disposed, it is possible to make it harder for the part of the transfer current to flow to the conveyance guide 26 in comparison with a case where the conveyance guide 26 is simply grounded. As described above, the varistor 28, serving as an electric resistance member, is disposed so as to flow the transfer current adequately for the transfer of the toner to the secondary transfer nip portion T2 when the secondary transfer voltage is applied to the secondary transfer inner roller 23.

To be noted, while the lower guide 26*b* is grounded via the varistor 28, it is not limited to this, and it is acceptable to ground the upper guide 26*a* via the varistor 28. Further, it is acceptable to use a resistor, a zener diode, and the like instead of the varistor 28.

Figure 3:
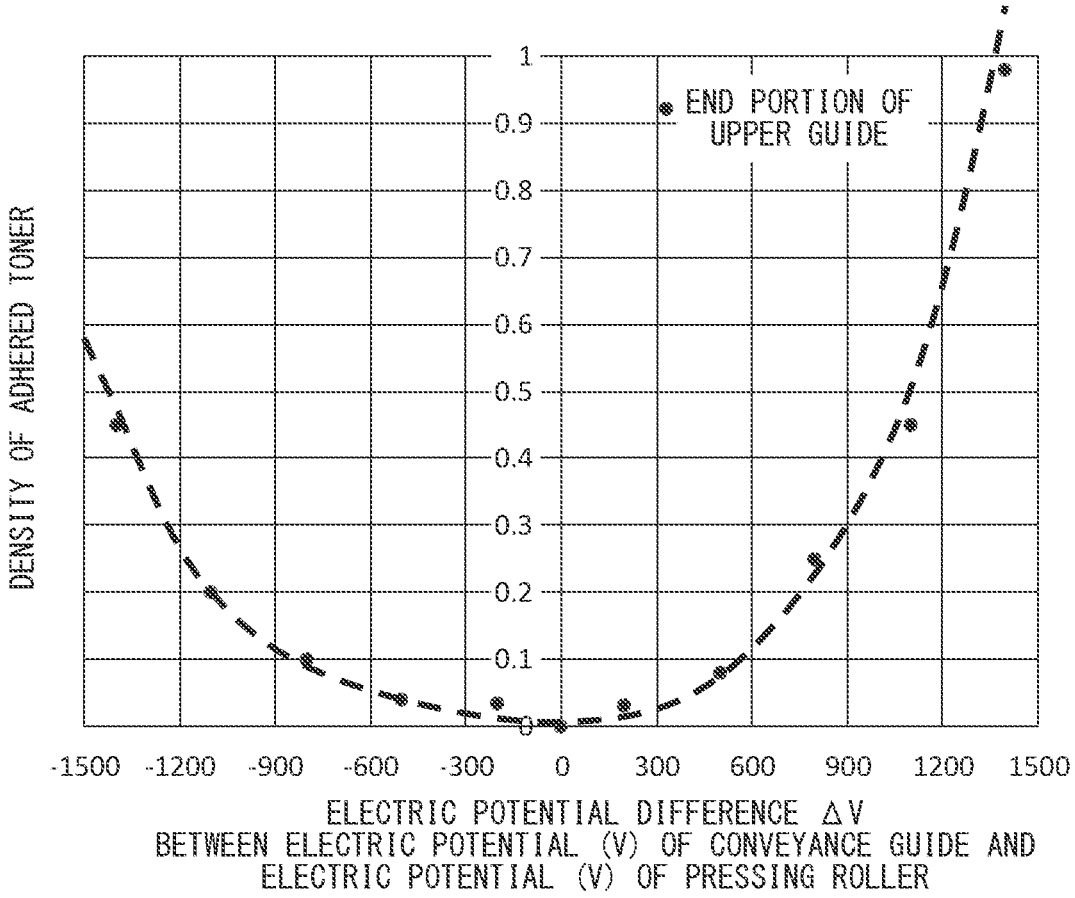
FIG. 3 is a graph showing the relation of an electrical potential difference between the pressing roller and conveyance guide to a toner adhering to the conveyance guide.

The relation of an electrical potential difference between the pressing roller 25 and conveyance guide 26 to the toner adhering to the conveyance guide 26 is shown in FIG. 3. In particular, FIG. 3 shows a result of an experiment. In the experiment, a voltage is applied from an external power source to each of the pressing roller 25 and conveyance guide 26 with the intermediate transfer belt 5 bearing the toner, and a density of the toner adhered to an end portion of the upper guide 26*a* is measured at each of the electrical potential differences ΔV. However, in this experiment, different from this embodiment, the pressing roller 25 and the conveyance guide 26 are not electrically connected to each other. To be noted, the toner density mentioned here is a density measured by an optical reflection densitometer, and is determined from the ratio between a light amount of irradiated light and a light amount of reflected light.

As shown in FIG. 3, the larger the electrical potential difference ΔV between the pressing roller 25 and conveyance guide 26 becomes, the higher the density of the toner adhering to the end portion of the upper guide 26*a* becomes. From this experimental result, it is found that, so as to prevent the toner from adhering to the end portion of the upper guide 26*a*, it is preferred to suppress the electrical potential difference between the pressing roller 25 and conveyance guide 26 within a range of, for example, −100 V to 100 V.

Figure 5:
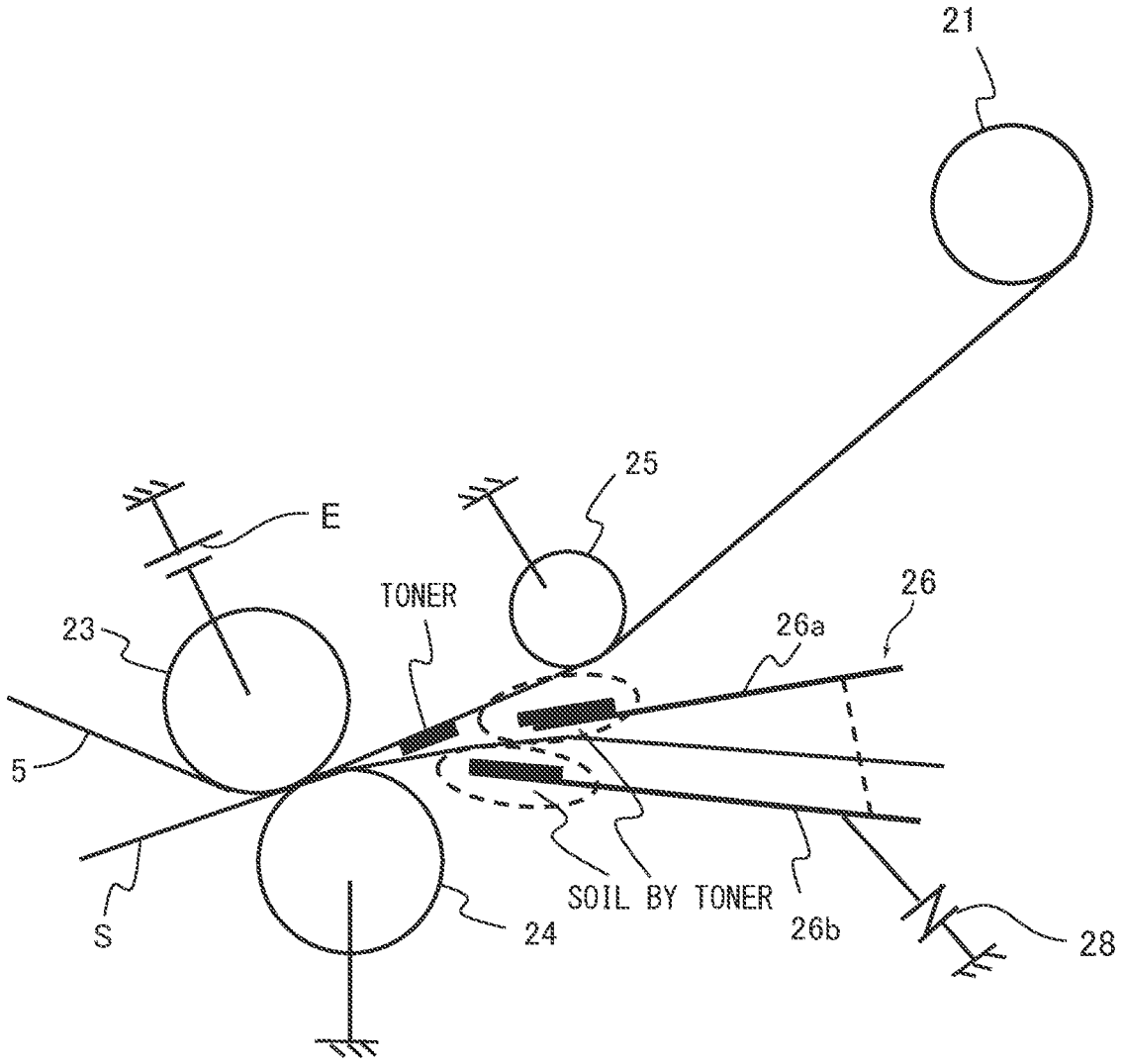
FIG. 5 is a schematic diagram showing a conventional example in which the pressing roller and conveyance guide are not electrically connected to each other.

At this point, a conventional example is indicated in FIG. 5. In the conventional example shown in FIG. 5, descriptions of configurations similar to this embodiment shown in FIG. 2 will be simplified or omitted herein by using the same reference characters. While the conventional example shown in FIG. 5 is the same as this embodiment in configurations in which the upper and lower guide 26 and 26*b* are electrically connected to each other and the lower guide 26*b* is grounded via the varistor 28, the conventional example is different from this embodiment in a configuration in which the pressing roller 25 and the conveyance guide 26 are not electrically connected to each other. Further, since the pressing roller 25 is grounded independently from the conveyance guide 26, the electric potential of the pressing roller 25 is 0 V.

In a case of the conventional example, when the conveyance guide 26 is charged by coming into slide contact with the recording material S, the electric potential difference is created between the pressing roller 25 and conveyance guide 26, and the difference is very large. Therefore, by the electric potential difference, part of the toner that is charged is attracted from the intermediate transfer belt 5, and adheres to the conveyance guide 26. If that happens, when the recording material S is subsequently guided to the conveyance guide 26, the toner adhering to the conveyance guide 26 moves to the recording material S, and causes the soil by the toner. The smaller a distance between the conveyance guide 26 and intermediate transfer belt 5 is, the more noticeable the soil of the toner described above becomes. So as to prevent this, it is considered to separate the conveyance guide 26 from the intermediate transfer belt 5. However, if the conveyance guide 26 is disposed separately from the intermediate transfer belt 5, while the pressing roller 25 presses the intermediate transfer belt 5, it becomes not possible to bring the recording material S into close contact with the intermediate transfer belt 5 with a certain length, and the faulty transfer becomes easy to occur. Therefore, it is difficult to dispose the conveyance guide 26 separately from the intermediate transfer belt 5.

In this embodiment, taking into consideration the above, as described above, the pressing roller 25 and the conveyance guide 26 are electrically connected to each other by electrically connecting the upper guide 26*a*, which is electrically connected to the lower guide 26*b* grounded via the varistor 28, to the pressing roller 25. Herewith, without disposing the conveyance guide 26 separately from the intermediate transfer belt 5, at least during a time when the recording material S is passing through the secondary transfer nip portion T2, it is possible to maintain the electric potential difference between the pressing roller 25 and conveyance guide 26 within a range not attracting the part of the toner to the conveyance guide 26. Thus, it is possible to prevent the toner from adhering to the conveyance guide 26. As described above, in this embodiment, it is possible to achieve both of the suppression of the faulty transfer of the toner from the intermediate transfer belt 5 to the recording material S and the prevention of the toner from adhering from the intermediate transfer belt 5 to the conveyance guide 26 with a simple configuration.

Second Embodiment

Next, using FIG. 4, a second embodiment will be described. To be noted, in the second embodiment shown in FIG. 4, descriptions of configurations similar to the first embodiment shown in FIG. 2 will be simplified or omitted herein by using the same reference characters.

While, in the first embodiment described above, a case disposing the pressing roller 25 so as to bring the intermediate transfer belt 5 to protrude outside (side of the secondary transfer outer roller 24) by pressing the intermediate transfer belt 5 from the inside is shown, it is not limited to this. As shown in FIG. 4, instead of the pressing roller 25, it is acceptable to use, for example, a pressing plate 251 tabularly formed by metal and the like having the electric conductivity. Alternatively, while an illustration is omitted, it is acceptable to use a tabularly formed plate member made of metal and the like having the electric conductivity and a sheet shaped pressing member in which a PET (polyethylene terephthalate) resin sheet is attached to the upstream side of the plate member. Even in this case, this embodiment is advantageous since the part of the toner is not attracted from the intermediate transfer belt 5 to the conveyance guide 26 even if static electricity (frictional electrification) is created on the PET resin sheet by friction associated with the passage of the recording material S. Further, it is acceptable to apply a configuration in which, using a resin plate which is tabularly formed by insulator resin and whose surface coming into contact with an inner circumferential surface of the intermediate transfer belt 5 is coated with resin and the like having the electrical conductivity, a coating portion of this resin plate and the conveyance guide 26 are electrically connected to each other.

Further, it is acceptable to dispose a pressing roller 27, serving as a second pressing member pressing the intermediate transfer belt 5 from the inside toward the outside on the upstream side of the pressing plate 251 (the pressing roller 25 in the case of the first embodiment (refer to FIG. 2)), serving as the first pressing member. In this embodiment, the pressing roller 27 serves as a second roller being adjacent to the secondary transfer inner roller 23 and disposed upstream of the secondary transfer inner roller 23 in the rotational direction of the intermediate transfer belt 5 so as to bring the recording material S further coming into close contact with the intermediate transfer belt 5 on the upstream side of the secondary transfer nip portion T2. Further, in an example shown in FIG. 4, the pressing roller 27 is connected to the pressing plate 251 via an electrically conductive member 34, serving as a second connecting member, and the pressing roller 27 is coupled to the conveyance guide 26 via an electrically conductive member 35, serving as the second connecting member. Therefore, the pressing plate 251 is electrically connected to the conveyance guide 26. Alternatively, it is acceptable to electrically connect the pressing plate 251 and the pressing roller 27 to each other via the electrically conductive member 34, and electrically connect the pressing plate 251 and the conveyance guide 26 to each other via the electrically conductive member 35.

Figure 4:
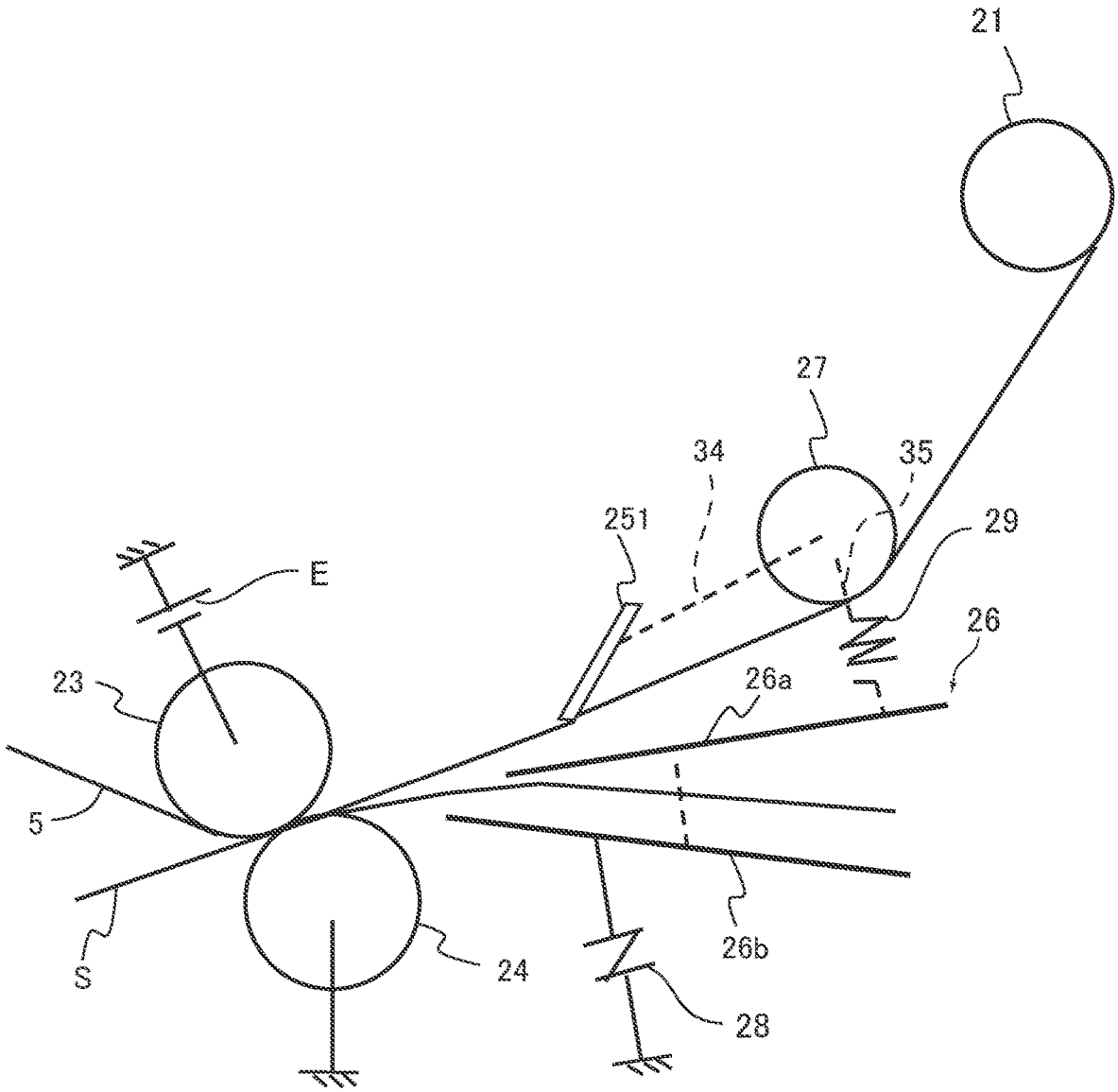
FIG. 4 is a schematic diagram showing a second embodiment.

To be noted, as shown in FIG. 4, in a case where the pressing plate 251 (the pressing roller 25 in the first embodiment (refer to FIG. 2)) and pressing roller 27 are electrically connected to the conveyance guide 26, it is preferred to perform the connecting via a resistor 29 having a smaller resistance as compared with the varistor 28. In the example shown in FIG. 4, the resistor 29 is disposed between the conveyance guide 26 and pressing plate 251. By disposing the resistor 29, it is possible to maintain an electric potential on a side of the pressing plate 251 and pressing roller 27 higher than the electric potential of the conveyance guide 26 within the range of the electric potential difference in which the part of toner is not attracted from the intermediate transfer belt 5 to the conveyance guide 26.

Alternative Embodiments

To be noted, while, in the first and second embodiments described above, the toner having a charging characteristic of the negative polarity is used and the secondary transfer voltage of the negative polarity is applied to the secondary transfer inner roller 23, it is not limited to this. For example, it is acceptable to apply the first and second embodiments to a configuration in which the toner having the charging characteristic of the negative polarity is used and the secondary transfer voltage with the positive polarity is applied to the secondary transfer outer roller 24. In comparison with the case where the secondary transfer voltage with the positive polarity is applied to the secondary transfer outer roller 24, in the case where the secondary transfer voltage with the negative polarity is applied to the secondary transfer inner roller 23, in some cases, the polarity of the toner is inverted to a side of the positive polarity in a process receiving an electric discharge during the primary transfer and the like. In the case where the toner with the positive polarity is generated, due to a relationship between the electric potential of the pressing roller 25 and the electric potential of the conveyance guide 26, the toner easily adheres to the conveyance guide 26. Therefore, it is possible to reduce an amount of the toner adhering to the conveyance guide 26 in the case of the configuration applying the secondary transfer voltage with the positive polarity to the secondary transfer outer roller 24. Even in such a case of the configuration applying the secondary transfer voltage with the positive polarity to the secondary transfer outer roller 24 as described above, by suppressing the electric potential difference between the pressing roller 25 and conveyance guide 26 within the range of, for example, −100 V to 100 V, it is possible to prevent the movement of the toner of the positive polarity as well as the toner of the negative polarity.

To be noted, it is acceptable to dispose the pressing roller 25 (pressing plate 251) capable of changing a pressing amount to press the intermediate transfer belt 5 depending on a type of the recording material S. For example, in a case where the recording material S is a high bending stiffness type, it is preferred to increase the pressing amount larger than a case where the recording material S is a low bending stiffness type. The type of the recording material S having the high bending stiffness includes cardboard with a grammage of equal to or more than 200 g/m$^2$ (grams per square meter), coated paper, OHP (overhead projector) sheet, and the like. For example, in a case where the grammage of the recording material S is 280 g/m$^2$, a change amount (for example, 0.9 mm) of the pressing amount is larger than a change amount (for example, 0.7 mm) of the pressing amount in a case where the grammage of the recording material S is 250 g/m$^2$. In a case where the pressing amount of the pressing roller 25 has been changed, in some cases, the gap between the intermediate transfer belt 5 and conveyance guide 26 (in particular, the upper guide 26) changes. In a case of this embodiment, since the toner is prevented from adhering to the conveyance guide 26 even in a case where the gap between the intermediate transfer belt 5 and conveyance guide 26 is narrowed, it is advantageous.

To be noted, while the first and second embodiments described above are shown by taking the example that forms the secondary transfer nip portion T2 by using the secondary transfer outer roller 24, it is not limited to this. For example, it is acceptable to form the secondary transfer nip portion T2 by using the secondary transfer belt that is in an endless shape and stretched by a plurality of stretching rollers.

Further, while the conveyance guide 26 described above is grounded via the varistor 28, for example, it is acceptable to configure the conveyance guide 26 (at least one of the upper guide 26*a* and the lower guide 26*b*) to include a resin member made of resin and an electrically conductive portion disposed on the resin member. The electrically conductive portion guides the recording material S by coming into contact with the recording material S that has been conveyed, and is grounded via the resin member. Since the volume resistivity of the resin member is configured to be larger than the volume resistivity of the electrically conductive portion, when a voltage becomes larger than a predetermined voltage, the static electricity generated in the electrically conductive portion is grounded via the resin member. In this case, since the resin member having the semiconductivity described above works as the electric resistance member, it is not necessary to dispose the electric resistance member such as the varistor.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s)

and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-207367, filed Dec. 15, 2020, which is hereby incorporated by reference herein in its entirety.

What is claimed is:

1. An image forming apparatus comprising:

an image forming unit configured to form a toner image;

an endless belt configured to carry and transfer the toner image;

a plurality of stretching rollers being in contact with an inner surface of the belt and configured to stretch the belt, the plurality of stretching rollers comprising:

a first roller configured to form a transfer portion where the toner image is transferred from the belt to a recording material; and a second roller being adjacent to the first roller and disposed upstream of the first roller with respect to a rotational direction of the belt;

a pressing member disposed upstream of the first roller and downstream of the second roller with respect to the rotational direction of the belt, and configured to press the belt from an inside;

a guide member disposed upstream of the transfer portion with respect to a conveyance direction of the recording material, and configured to guide the recording material toward the transfer portion; and a connecting member configured to electrically connect the guide member and the pressing member so that the guide member and the pressing member are at an equal potential.

2. The image forming apparatus according to claim 1, wherein the guide member comprises a first guide configured to guide a first surface of the recording material, and a second guide disposed between the first guide and the belt and configured to guide a second surface of the recording material, and wherein the connecting member is configured to electrically connect the second guide and the pressing member so that the second guide and the pressing member are at an equal potential.

3. The image forming apparatus according to claim 2, wherein either one of the first guide and the second guide is configured to be grounded via a varistor, and the first guide and the second guide are configured to be electrically connected so that the first guide and the second guide are at equal potential.

4. The image forming apparatus according to claim 1, further comprising a power source configured to apply a voltage with a same polarity as a toner to the first roller.

5. The image forming apparatus according to claim 1, further comprising a second connecting member configured to electrically connect the guide member or the pressing member to the second roller so that the guide member and the second roller are at equal potential.

6. The image forming apparatus according to claim 1, wherein the pressing member is in a sheet shape.

7. The image forming apparatus according to claim 1, wherein the pressing member comprises a roller.

8. The image forming apparatus according to claim 1 further comprising a transfer member coming into contact with an outer circumferential surface of the belt and configured to form the transfer portion in cooperation with the first roller, wherein the transfer member comprises a belt.

9. The image forming apparatus according to claim 1, further comprising a transfer member coming into contact with an outer circumferential surface of the belt and configured to form the transfer portion in cooperation with the first roller, wherein the transfer member comprises a roller.

10. An image forming apparatus comprising:

an image forming unit configured to form a toner image;

an endless belt configured to carry and transfer the toner image;

a plurality of stretching rollers being in contact with an inner surface of the belt and configured to stretch the belt, the plurality of stretching rollers comprising:

a first roller configured to form a transfer portion where the toner image is transferred from the belt to a recording material; and a second roller being adjacent to the first roller and disposed upstream of the first roller with respect to a rotational direction of the belt;

a pressing member disposed upstream of the first roller and downstream of the second roller with respect to the rotational direction of the belt, and configured to press the belt from an inside;

a guide member disposed upstream of the transfer portion with respect to a conveyance direction of the recording material, and configured to guide the recording material toward the transfer portion; and a connecting member configured to electrically connect the guide member and the pressing member so that a potential difference between the guide member and the pressing member is 100 V or less.

11. An image forming apparatus comprising:

an image forming unit configured to form a toner image;

an endless belt configured to carry the toner image transferred from the image forming unit;

an inner roller being in contact with an inner surface of the belt and configured to stretch the belt to form a transfer portion where the toner image is transferred from the belt to a recording material; and an outer member coming into contact with an outer circumferential surface of the belt and configured to form the transfer portion in cooperation with the inner roller;

a pressing member disposed upstream of the inner roller with respect to a rotational direction of the belt, and configured to press the belt from an inside;

a guide member disposed upstream of the transfer portion with respect to a conveyance direction of the recording material, and configured to guide the recording material toward the transfer portion; and a connecting member configured to electrically connect the guide member and the pressing member so that the guide member and the pressing member are at an equal potential or a potential difference between the guide member and the pressing member is 100 V or less.

12. The image forming apparatus according to claim 11, wherein the guide member comprises a first guide configured to guide a first surface of the recording material, and a second guide disposed between the first guide and the belt and configured to guide a second surface of the recording material, and wherein the connecting member is configured to electrically connect the second guide and the pressing member so that the second guide and the pressing member are at an equal potential.

13. The image forming apparatus according to claim 12, wherein either one of the first guide and the second guide is configured to be grounded via a varistor, and the first guide and the second guide are configured to be electrically connected so that the first guide and the second guide are at equal potential.

14. The image forming apparatus according to claim 11, further comprising a power source configured to apply a voltage with a same polarity as a toner to the inner roller.

15. The image forming apparatus according to claim 11, further comprising an upstream roller disposed upstream of the pressing member with respect to the rotational direction of the belt, and the connecting member is configured to electrically connect the pressing member via the upstream roller to the guide member so that the pressing member, the guide member, and the upstream roller are at equal potential or a potential difference among the pressing member, the guide member, and the upstream roller is 100 V or less.

16. The image forming apparatus according to claim 11, wherein the pressing member is in a sheet shape.

17. The image forming apparatus according to claim 11, wherein the pressing member comprises a roller.

18. The image forming apparatus according to claim 11, wherein the outer member comprises a belt.

19. The image forming apparatus according to claim 11, wherein the outer member comprises a roller.

20. The image forming apparatus according to claim 15, further comprising:

an upstream roller disposed upstream of the pressing member with respect to the rotational direction of the belt; and a second connecting member configured to electrically connect the pressing member to the upstream roller so that the pressing member and the upstream roller are at equal potential.

21. The image forming apparatus according to claim 11, wherein the pressing member is adjacent to the inner roller.

22. The image forming apparatus according to claim 11, wherein the pressing member is opposed to the guide member across the belt.

* * * * *